US009248502B2

(12) United States Patent
Hood

(10) Patent No.: US 9,248,502 B2
(45) Date of Patent: Feb. 2, 2016

(54) HOT ISOSTATIC PRESSING TOOL AND A METHOD OF MANUFACTURING AN ARTICLE FROM POWDER MATERIAL BY HOT ISOSTATIC PRESSING

(71) Applicant: ROLLS-ROYCE PLC, London (GB)

(72) Inventor: Christopher J. Hood, Derby (GB)

(73) Assignee: ROLLS-ROYCE plc, London (GB)

( * ) Notice: Subject to any disclaimer, the term of this patent is extended or adjusted under 35 U.S.C. 154(b) by 699 days.

(21) Appl. No.: 13/665,383

(22) Filed: Oct. 31, 2012

(65) Prior Publication Data

US 2013/0115127 A1 May 9, 2013

(30) Foreign Application Priority Data

Nov. 8, 2011 (GB) ..... 1119240.8

(51) Int. Cl.

| | |
|---|---|
| ***B22F 3/15*** | (2006.01) |
| ***B29C 43/02*** | (2006.01) |
| ***B28B 3/00*** | (2006.01) |
| ***B30B 15/02*** | (2006.01) |

(52) U.S. Cl.

CPC ..... *B22F 3/15* (2013.01); *B30B 15/022* (2013.01); *B22F 2003/153* (2013.01)

(58) Field of Classification Search

CPC .... B22F 3/15; B22F 2003/153; B30B 15/022
USPC ..... 425/77, 78, 405.2; 419/48–51, 68; 264/125, 332

See application file for complete search history.

(56) References Cited

U.S. PATENT DOCUMENTS

| | | | | |
|---|---|---|---|---|
| 4,135,286 | A | | 1/1979 | Wright et al. |
| 4,834,917 | A | * | 5/1989 | Ramm et al. ..... 264/125 |
| 5,100,867 | A | | 3/1992 | Gunzelmann et al. |
| 7,234,920 | B2 | | 6/2007 | Imbourg et al. |
| 7,575,425 | B2 | | 8/2009 | Hall et al. |
| 7,687,021 | B2 | | 3/2010 | Imbourg et al. |
| 7,927,085 | B2 | | 4/2011 | Hall et al. |

FOREIGN PATENT DOCUMENTS

| | | |
|---|---|---|
| DE | 10 2005 007 777 A1 | 8/2006 |
| JP | A-62-274006 | 11/1987 |
| JP | U-01-066597 | 4/1989 |
| JP | A-09-194905 | 7/1997 |

OTHER PUBLICATIONS

Search Report issued in British Application No. 1119238.2 dated Mar. 7, 2012.

(Continued)

*Primary Examiner* — Joseph S Del Sole
*Assistant Examiner* — Thukhanh T Nguyen
(74) *Attorney, Agent, or Firm* — Oliff PLC

(57) ABSTRACT

A hot isostatic pressing tool comprises a canister and a support structure. The canister forming an annular chamber to receive a powder material to be hot isostatically pressed, the annular chamber having an annular portion having a predetermined radial dimension and at least one annular sub portion at a predetermined axial position having a radial dimension greater than the predetermined radial dimension. The support structure comprising at least one annular member arranged radially within the canister. The at least one annular member is located radially within the at least one annular sub portion of the annular chamber to support the canister at the predetermined axial position.

22 Claims, 9 Drawing Sheets

(56) References Cited

OTHER PUBLICATIONS

U.S. Appl. No. 13/665,260, filed Oct. 31, 2012 in the name of Christopher J. Hood.

Search Report issued in British Application No. 1119240.8 dated Mar. 20, 2012.

Aug. 28, 2015 Notice of Allowance issued in U.S. Appl. No. 13/665,260.

* cited by examiner

HOT ISOSTATIC PRESSING TOOL AND A METHOD OF MANUFACTURING AN ARTICLE FROM POWDER MATERIAL BY HOT ISOSTATIC PRESSING

The present invention relates to a hot isostatic pressing tool and a method of manufacturing an article from powder material by hot isostatic pressing, e.g. HIP.

Hot isostatic pressing is a processing technique in which high isostatic pressure is applied to a powder material contained in a sealed and evacuated canister at a high temperature to produce a substantially 100% dense article. The industry standard is to manufacture the canisters used in the hot isostatic pressing process from mild steel sheet, approximately 3 mm thick. The canister conventionally used comprises a plurality of separate portions which are joined together by welded joints to form the completed canister. During the hot isostatic pressing cycle, the canister collapses as a result of the high gas pressures and high temperatures applied and results in compaction, or consolidation, of the powder material. The collapsing of the canister is sometimes uneven and this may result in distortion of the canister and uneven compaction, or consolidation, of the powder material and ultimately a distorted article at the end of the hot isostatic pressing cycle.

As a consequence of the capability of the hot isostatic pressing process to control size and shape, the canisters are designed to produce articles which are considerably oversize, with generally a minimum oversize of about 5 mm. This is considered to be near nett shape. The additional material in the oversized article adds a considerable amount of extra material, and there is the cost of the extra material. The extra material has to be removed, for example by machining, after the hot isostatic process to result in the final size and shape of the article and this adds more cost. The additional material has to undergo hot isostatic processing and increases the duration of the hot isostatic processing.

A problem with the hot isostatic pressing process is that the canister collapses by different amounts in different regions of the canister as a result of different dimensions of the chamber at the different regions of the canister and this is due to the compaction, or consolidation, of the powder material in the chamber. The greater the dimension of the chamber at a particular region, the greater is the change in the dimension of the chamber after compaction, consolidation, of the powder material as a result of the hot isostatic pressing process. This may result in the dimensions of the finished article being closer to the required dimensions in some regions than other regions.

Accordingly the present invention seeks to provide a hot isostatic pressing tool and a method of manufacturing an article from powder material by hot isostatic pressing which reduces, preferably overcomes, the above mentioned problem.

Accordingly the present invention provides a hot isostatic pressing tool comprising a canister and a support structure, the canister forming an annular chamber to receive a powder material to be hot isostatically pressed, the support structure comprising at least one annular member arranged radially within the canister, the at least one annular member being located radially within the canister to support the canister at a predetermined axial position.

The at least one annular member may be arranged to support a radially inner surface of the canister.

The at least one annular member may be separate from the canister. The radially outer surface of the at least one annular member may be the same or less than the radially inner diameter of the radially inner wall portion of the canister. The radially outer surface of each annular support member is arranged to abut the radially inner surface of a radially inner wall portion of the canister during hot isostatic pressing to support the canister. The annular support member may extend radially inwardly to a radially inner diameter less than the radially inner diameter of the radially inner wall portion of the canister.

The at least one annular support member may be integral with the canister and extend radially inwardly to a radially inner diameter less than the radially inner diameter of the radially inner wall portion of the canister.

The annular chamber may have an annular portion having a predetermined radial dimension and at least one annular sub portion at the predetermined axial position having a radial dimension greater than the predetermined radial dimension, the at least one annular member being located radially within the at least one annular sub portion of the annular chamber to support the canister at the predetermined axial position.

The hot isostatic pressing tool may comprise an inner cylindrical canister member, an outer cylindrical canister member, a first end ring and a second end ring, the inner cylindrical canister member, the outer cylindrical canister member, the first end ring and the second end ring forming the annular chamber, the outer cylindrical canister member being spaced radially outwardly from the inner cylindrical canister member to form the annular portion of the chamber.

The first end ring and a first end of the inner cylindrical canister member may have interlocking features forming a U-shaped or a Z-shaped leakage flow path between the first end ring and the first end of the inner cylindrical canister member, the second end ring and a second end of the inner cylindrical canister member having interlocking features forming a U-shaped or a Z-shaped leakage flow path between the second end ring and the second end of the inner cylindrical canister member, the first end ring and a first end of the outer cylindrical canister member having interlocking features forming a U-shaped or a Z-shaped leakage flow path between the first end ring and the first end of the outer cylindrical canister member, the second end ring and a second end of the outer cylindrical canister member having interlocking features forming a U-shaped or a Z-shaped leakage flow path between the second end ring and the second end of the outer cylindrical canister member.

The first end ring may form a first annular sub portion of the chamber and the annular member being located radially within the first annular sub portion of the annular chamber to support the first end ring at the predetermined axial position.

The annular member may be integral with the first end ring, the annular member is a radially inwardly extending annular portion of the first end ring, the radially inner diameter of the annular portion is less than the radially inner diameter of the inner cylindrical canister member.

The second end ring may form a second annular sub portion of the annular chamber and a second annular member being located radially within the second annular sub portion of the annular chamber to support the second end ring at a second predetermined axial position.

The second annular member may be integral with the second end ring, the second annular member is a radially inwardly extending annular portion of the second end ring, and the radially inner diameter of the annular portion is less than the radially inner diameter of the inner cylindrical canister member.

The first annular member may be separate from the first end ring and the second annular member may be separate from the second end ring. At least one axially extending support member may extend between and is secured to the first annular member and the second annular member. The at least one axially extending support member may comprise graphite or a ceramic.

The first annular support member and the second annular support member may comprise a high nickel iron alloy. The high nickel iron alloy may consist of 25 wt % nickel, 20 wt % chromium and the balance iron and incidental impurities.

The canister may comprise mild steel. The mild steel may comprise 2 wt % carbon.

The present invention also provides a hot isostatic pressing tool comprising a canister and a support structure, the canister forming an annular chamber to receive a powder material to be hot isostatically pressed, the annular chamber having an annular portion having a predetermined radial dimension and at least one annular sub portion at a predetermined axial position having a radial dimension greater than the predetermined radial dimension, the support structure comprising at least one annular member arranged radially within the canister, the at least one annular member being located radially within the at least one annular sub portion of the annular chamber to support the canister at the predetermined axial position.

The present invention also provides a method of manufacturing an article from powder material by hot isostatic pressing, the method comprising the steps of:—a) forming a canister, the canister defining an annular chamber to receive a powder material to be hot isostatically pressed, b) forming a support structure, the support structure comprising at least one annular member, c) arranging the at least one annular member radially within the canister, locating the at least one annular member radially within the canister to support the canister at a predetermined axial position to form a hot isostatic pressing tool, d) supplying powder material into the annular chamber, e) evacuating gases from the chamber and then sealing the annular chamber, f) applying heat and pressure to consolidate the powder material within the annular chamber of the hot isostatic pressing tool to form a consolidated powder material article and g) removing the hot isostatic pressing tool from the consolidated powder material article.

Step a) the annular chamber may have an annular portion having a predetermined radial dimension and at least one annular sub portion at a predetermined axial position having a radial dimension greater than the predetermined radial dimension, and step c) comprises locating the at least one annular member radially within the at least one annular sub portion of the annular chamber to support the canister at the predetermined axial position to form the hot isostatic pressing tool.

Step a) may comprise forming an inner cylindrical canister member, forming an outer cylindrical canister member, forming a first end ring, forming a second end ring and arranging the outer cylindrical canister member such that it is spaced radially outwardly from the inner cylindrical canister member to form the annular chamber.

Step a) may comprise providing the first end ring and a first end of the inner cylindrical canister member with interlocking features forming a U-shaped or a Z-shaped leakage flow path between the first end ring and the first end of the inner cylindrical canister member, providing the second end ring and a second end of the inner cylindrical canister member with interlocking features forming a U-shaped or a Z-shaped leakage flow path between the second end ring and the second end of the inner cylindrical canister member, providing the first end ring and a first end of the outer cylindrical canister member with interlocking features forming a U-shaped or a Z-shaped leakage flow path between the first end ring and the first end of the outer cylindrical canister member and providing the second end ring and a second end of the outer cylindrical canister member with interlocking features forming a U-shaped or a Z-shaped leakage flow path between the second end ring and the second end of the outer cylindrical canister member, sealing the first end ring to the first end of the inner cylindrical canister member, sealing the second end ring to the second end of the inner cylindrical canister member, sealing the first end ring to the first end of the outer cylindrical canister member and sealing the second end ring to the second end of the outer cylindrical canister member.

Step a) may comprise forming a first annular sub portion of the chamber in the first end ring and locating the annular member radially within the first annular sub portion of the annular chamber to support the first end ring at the predetermined axial position.

Step b) may comprise forming the annular member integral with the first end ring, the annular member being a radially inwardly extending annular portion of the first end ring, the radially inner diameter of the annular portion being less than the radially inner diameter of the inner cylindrical canister member.

Step a) may comprise forming a second annular sub portion of the annular chamber in the second end ring and locating a second annular member radially within the second annular sub portion of the annular chamber to support the second end ring at a second predetermined axial position, Step b) may comprise forming the second annular member integral with the second end ring, the second annular member being a radially inwardly extending annular portion of the second end ring, the radially inner diameter of the annular portion being less than the radially inner diameter of the inner cylindrical canister member.

The consolidated powder material article may be a casing. The casing may be a gas turbine engine casing. The casing may be a turbine casing, a compressor casing, a fan casing or a combustion casing.

The powder material may comprise a powder metal or a powder alloy.

The powder alloy may comprise a nickel base superalloy, a titanium alloy or a steel alloy. The method may comprise supplying different powder metals or different powder alloys into different regions of the chamber.

The present invention also provides a method of manufacturing an article from powder material by hot isostatic pressing, the method comprising the steps of:—a) forming a canister, the canister defining an annular chamber to receive a powder material to be hot isostatically pressed, the annular chamber having an annular portion having a predetermined radial dimension and at least one annular sub portion at a predetermined axial position having a radial dimension greater than the predetermined radial dimension, b) forming a support structure, the support structure comprising at least one annular member, c) arranging the at least one annular member radially within the canister, locating the at least one annular member radially within the at least one annular sub portion of the annular chamber to support the canister at the predetermined axial position to form a hot isostatic pressing tool, d) supplying powder material into the annular chamber, e) evacuating gases from the chamber and then sealing the annular chamber, f) applying heat and pressure to consolidate the powder material within the annular chamber of the hot isostatic pressing tool to form a consolidated powder material article and g) removing the hot isostatic pressing tool from the consolidated powder material article.

The present invention will be more fully described by way of example with reference to the accompanying drawings, in which.

Figure 7:
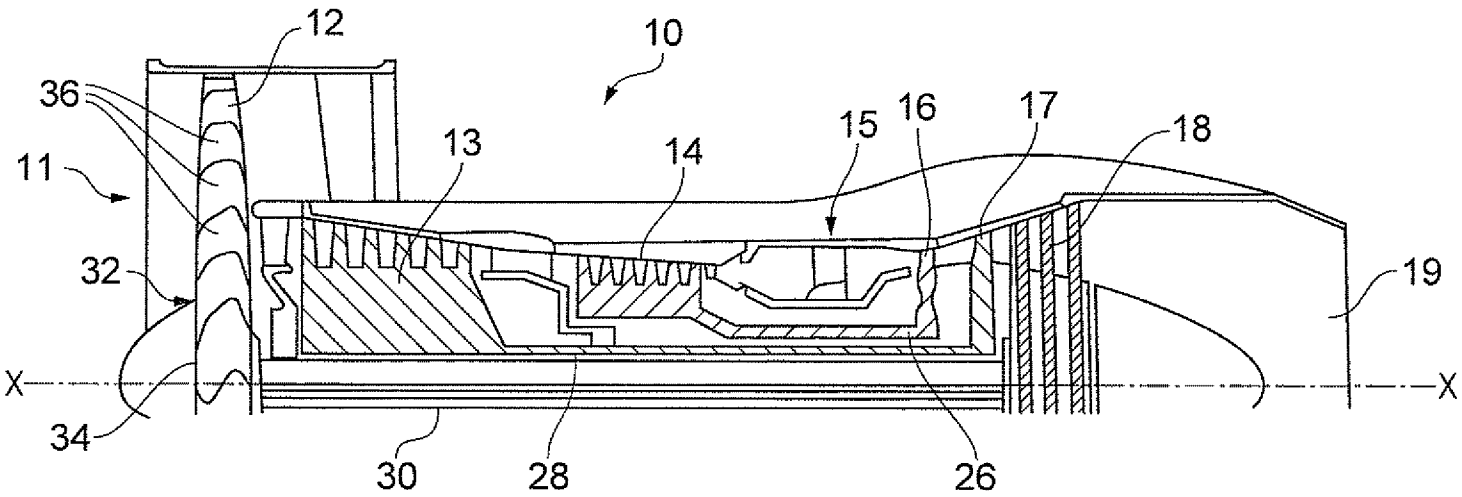
FIG. 7 is a turbofan gas turbine engine having a casing manufactured from powder material by hot isostatic pressing according to the present invention.

A turbofan gas turbine engine 10, as shown in FIG. 7, comprises in flow series an intake 11, a fan 12, an intermediate pressure compressor 13, a high pressure compressor 14, a combustor 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 14 via a second shaft 28 and the low pressure turbine 19 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustor 15. Fuel is injected into the combustor 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

The fan 12, the intermediate pressure compressor 13, the high pressure compressor 14, the combustor 15, the high pressure turbine 16, the intermediate pressure turbine 17 and the low pressure turbine 18 are each enclosed by a respective casing.

Figure 8:
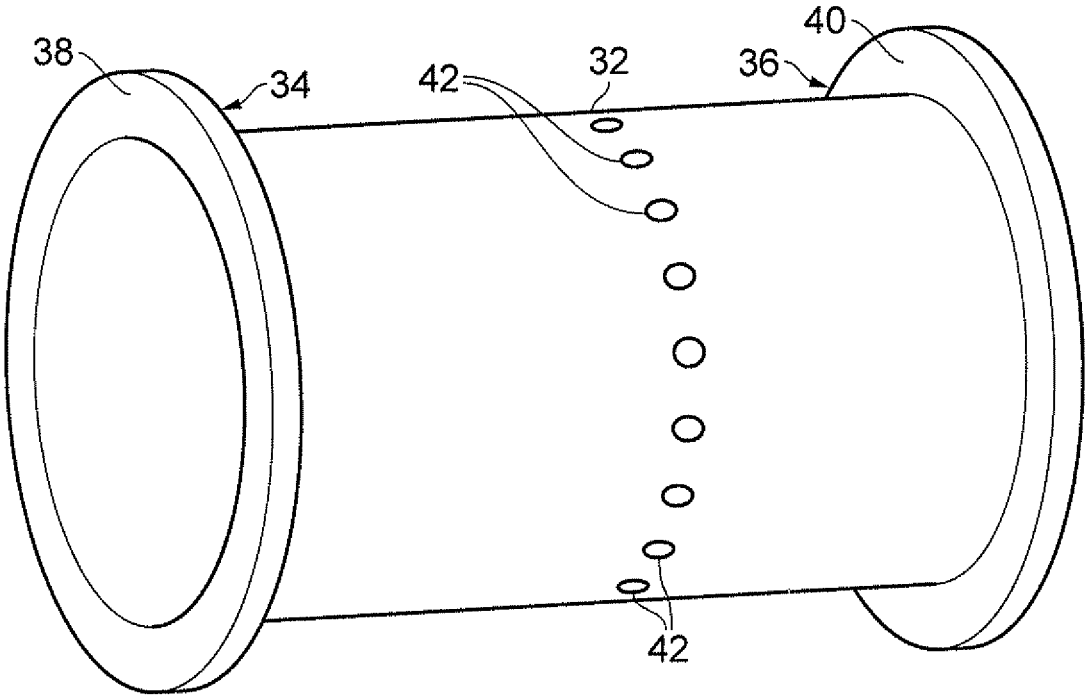
FIG. 8 is an enlarged perspective view of the casing shown in FIG. 7.

A combustor casing 32 is shown more clearly in FIG. 8 and the combustor casing 32 comprises an annular radially outwardly extending flange 38 at an upstream end 34 of the combustor casing 32 and an annular radially outwardly extending flange 40 at a downstream end 36 of the combustor casing 32. The flanges 38 and 40 enable the combustor casing 32 to be secured to a casing of the adjacent high pressure compressor 14 and a casing of the high pressure turbine 16. The combustor casing 14 also has a plurality of circumferentially spaced apertures 42, which have associated bosses and threaded blind holes, to allow fuel injectors 44 to be inserted into the combustion chamber 15.

The combustor casing 32 is manufactured by hot isostatic pressing of a powder material, e.g. a powder metal or powder alloy. The powder alloy may be a nickel-base superalloy.

Figure 1:
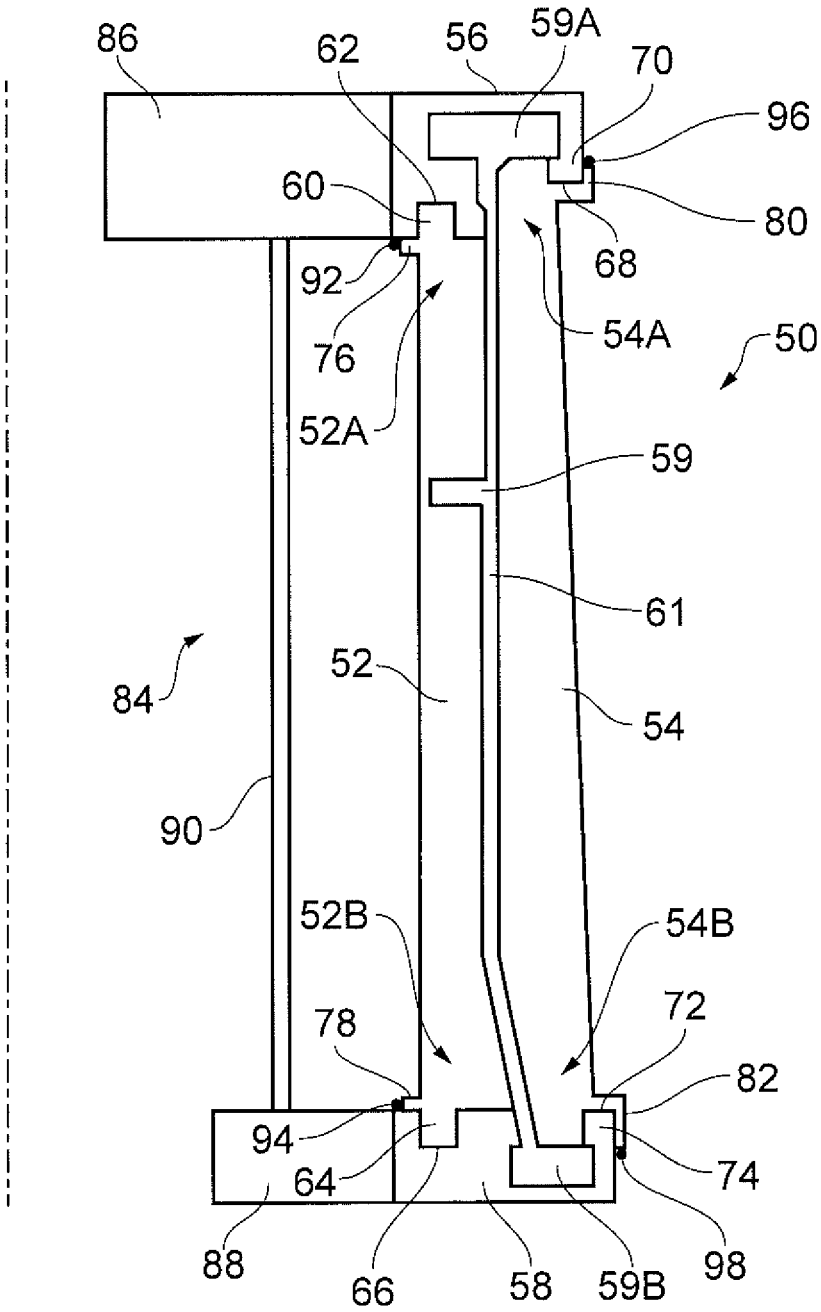
FIG. 1 is a longitudinal cross-sectional view through half of a hot isostatic pressing tool according to the present invention.

The combustor casing 32 is manufactured using a hot isostatic pressing tool 50 as shown in FIG. 1. The hot isostatic pressing tool 50 comprises a plurality of canister members 52, 54, 56 and 58 and the hot isostatic pressing tool 50 comprises at least one set of adjacent canister members. In this case a first end 52A of canister member 52 is adjacent canister member 56 and a second end 52B of canister member 52 is adjacent canister member 58. Similarly a first end 54A of canister member 54 is adjacent canister member 56 and a second end 54B of canister member 54 is adjacent canister member 58. The plurality of canister members 52, 54, 56 and 58 form, or define, a chamber 59 to receive a powder material 61 to be hot isostatically pressed. The at least one set of adjacent canister members 52, 54, 56 and 58 having interlocking features forming a U-shaped or a Z-shaped leakage flow path between the at least one set of adjacent second canister members. In this case each set of adjacent of canister members has interlocking features forming a U-shaped or a Z-shaped leakage flow path between each set of adjacent second canister members. In this case the first end 52A of canister member 52 and the adjacent canister member 56 have interlocking features 60 and 62 respectively and the second end 52B of canister member 52 and the adjacent canister member 58 have interlocking features 64 and 66 respectively. The first end 54A of canister member 54 and the adjacent canister member 56 have interlocking features 68 and 70 respectively and the second end 54B of canister member 54 and the adjacent canister member 58 have interlocking features 72 and 74 respectively.

The hot isostatic pressing tool 50 actually comprises an inner cylindrical canister member 52, an outer cylindrical canister member 54, a first end ring 56 and a second end ring 58. The outer cylindrical canister member 54 is spaced radially outwardly from the inner cylindrical canister member 52 to form the chamber 59 to receive the powder material 61 to be hot isostatically pressed. The first end ring 56 and the first end 52A of the inner cylindrical canister member have interlocking features 60 and 62 forming a U-shaped or a Z-shaped leakage flow path between the first end ring 56 and the first end 52A of the inner cylindrical canister member 52. Likewise the second end ring 58 and the second end 52B of the inner cylindrical canister member 52 have interlocking features 64, 66 forming a U-shaped or a Z-shaped leakage flow path between the second end ring 58 and the second end 52B of the inner cylindrical canister member 52. The first end ring 56 and the first end 54A of the outer cylindrical canister member 54 have interlocking features 68 and 70 forming a U-shaped or a Z-shaped leakage flow path between the first end ring 56 and the first end 54A of the outer cylindrical canister member 54. Likewise the second end ring 58 and a second end 54B of the outer cylindrical canister member 54 have interlocking features 72 and 74 forming a U-shaped or a Z-shaped leakage flow path between the second end ring 58 and the second end 54B of the outer cylindrical canister member 54.

The interlocking features of the first end ring 56 and the first end 52A of the inner cylindrical canister member 52 comprise an annular axially extending projection 60 on the inner cylindrical canister member 52 and an annular groove 62 in the first end ring 56. The interlocking features 60 and 62 form a series of Z-shaped leakage flow paths between the first end ring 56 and the first end 52A of the inner cylindrical canister member 52. The first end 52A of the inner cylindrical canister member 52 has a radially inwardly extending membrane 76 abutting the first end ring 56.

The interlocking features of the second end ring 58 and the second end 52B of the inner cylindrical canister member 52 comprise an annular axially extending projection 64 on the inner cylindrical canister member 52 and an annular groove 66 in the second end ring 58. The interlocking features 64 and 66 form a series of Z-shaped leakage flow paths between the second end ring 58 and the second end 52B of the inner cylindrical canister member 52. The second end 52B of the inner cylindrical canister member 52 has a radially inwardly extending membrane 78 abutting the second end ring 58.

The interlocking features of the first end ring 56 and the first end 54A of the outer cylindrical canister member 54 comprise an annular axially extending projection 70 on the first end ring 56 and an annular groove 68 in the first end 54A of the outer cylindrical canister member 54. The interlocking features form a U-shaped leakage flow path between the first end ring 56 and the first end 54A of the outer cylindrical canister member 54. The first end 54A of the outer cylindrical canister member 54 has a radially outwardly and axially extending membrane 80 abutting the annular projection 70 on the first end ring 56. The membrane 80 partially defines the annular groove 68. The interlocking features of the second end ring 58 and the second end 54B of the outer cylindrical canister member 54 comprise an annular axially extending projection 74 on the second end ring 58 and an annular groove 72 in the second end 54B of the outer cylindrical canister member 54. The interlocking features form a U-shaped leakage flow path between the second end ring 58 and the second end 54B of the outer cylindrical canister member 54. The second end 54B of the outer cylindrical canister member 54 has a radially outwardly and axially extending membrane 82 abutting the annular projection 72 on the second end ring 58.

The inner cylindrical canister member 52, the outer cylindrical canister member 54, the first end ring 56 and the second end ring 58 actually form an annular chamber 59, and the outer cylindrical canister member 54 is spaced radially outwardly from the inner cylindrical canister member 52 by a predetermined radial dimension to form a main annular portion 59C of the annular chamber 59. The first end ring 56 is hollow and defines a first annular sub portion 59A of the chamber 59 which is interconnected with the main annular portion 59C of the annular chamber 59 to receive the powder material 61 to be hot isostatically pressed. The second end ring 58 is hollow and defines a second annular sub portion 59B of the annular chamber 59 which is interconnected with the main annular portion 59C of the annular chamber 59 to receive the powder material 61 to be hot isostatically pressed. The first annular sub portion 59A and the second annular sub portion 59B are at first and second predetermined axial positions. The first annular sub portion 59A has a first radial dimension which is greater than the predetermined radial dimension of the main annular portion 59C of the annular chamber 59 and the second annular sub portion 59B has a second radial dimension which is greater than the predetermined radial dimension of the main annular portion 59C of the annular chamber 59. The first and second radial dimensions may be the same or different. The main portion 59C of the annular chamber 59 defines the main cylindrical, conical or frustoconical portion of the finished combustor casing 32, the first and second annular sub portions 59A and 59B define the flanges 38 and 40 on the finished combustor casing 32.

The hot isostatic pressing tool 50 also comprises a support structure 84. The support structure 84 comprises a first annular support member 86, a second annular support member 88 and an axially extending support member 90 or a plurality of axially extending support members 90. The first annular support member 86 is located radially within the first annular sub portion 59A of the annular chamber 59 to support the first end ring 56 at the first predetermined axial position. The radially outer surface of the first annular support member 86 is radially within the radially inner surface of the first end ring 56. The second annular support member 88 is located radially within the second annular sub portion 59B of the annular chamber 59 to support the second end ring 58 at the second predetermined axial position. The radially outer surface of the second annular support member 88 is radially within the radially inner surface of the second end ring 58. The fit between the first and second annular support members 86 and 88 and the corresponding first and second end rings 56 and 58 is such that at room temperature the support structure 84 is easily placed coaxially within the first and second end rings 56 and 58 but at the hot isostatic pressing temperature the relative thermal expansion of the first annular support member 86 and the first end ring 56 and the relative expansion of the second annular support member 88 and the second end ring 56 is such that the radially outer surface of the first annular support member 86 abuts the radially inner surface of the first end ring 56 and the radially outer surface of the second annular support member 88 abuts the radially inner surface of the second end ring 58 to control the radial positions of the first and second end rings 56 and 58 and hence control the final positions and shape of the flanges 38 and 40 in the finished combustor casing 32. The first and second annular support members 86 and 88 extend in a radially inward direction to a radially inner diameter much less than the radially inner diameter of the inner cylindrical canister member 52. The annular support members 86 and 88 may be provided with radially and or circumferentially extending buttresses and/or support ribs to provide stiffening of the annular support members 86 and 88 to reduce deformation over a number of hot isostatic pressing cycles if reused and to reduce the overall thermal mass of the annular support members 86 and 88. The axially extending support member, or members, 90 extend between and are secured to the first and second annular support members 86 and 88. The axially extending support member or members 90 may be constructed from tubes, blocks, pillars or from a framework.

The first annular support member 86 and the second annular support member 88 of the support structure 84 comprise a high nickel iron alloy. The high nickel iron alloy may consist of 25 wt % nickel, 20 wt % chromium and the balance iron. The use of a support structure 84 consisting of these materials may be used repeatedly to support different hot isostatic pressing tools. The individual annular support members 86 and 88 may be tuned for each casing type in order to enable more consistent and repeatable shape control of the casing. The greater the mass of an individual annular support member 86 and/or 88 the greater the local support provided by the annular support member 86 and 88. It is seen that the first and second annular support members 86 and 88 have different radially inner dimensions, have different volumes and have different masses and hence provide different amounts of support to the radially inner surface of the canister, e.g. the first and second end rings 56 and 58 of the canister and the first annular support member 86 provides the greatest support and is at a vertically upper end of the canister. The axially extending support member or members 90 may comprise a suitable metal, graphite or a ceramic. The axially extending support members 90 are constructed and/or arranged to enable effective convective heat transfer and prevent stagnation within the radially inner canister member 52. A framework of axially extending support members may be manufactured from laser cut metal secured together by welding or by interlocking sheet metal joints. The first annular support member 86 has a coaxial bore extending there-through and enables the support structure 84 to be inserted or removed in an axial direction from the canister, for example by lowering or lifting the support structure 84 if the canister is arranged with its axis vertical.

A release agent such as boron nitride or yttria is applied to the contacting radially outer surfaces of the first and second annular support members 86 and 88 and the corresponding radially inner surfaces of the first and second end rings 56 and 58.

The combustor casing 32 is manufactured from powder alloy by hot isostatic pressing. The method comprises the steps of:—a) forming a canister 52, 54, 56 and 58, the canister 52, 54, 56 and 58 defining an annular chamber 59 to receive a powder material to be hot isostatically pressed, the annular chamber 59 having an annular portion 59C having a predetermined radial dimension and at least one annular sub portion 59A and 59B at a predetermined axial position having a radial dimension greater than the predetermined radial dimension, b) forming a support structure 84, the support structure comprising at least one annular member 86 and 88, c) arranging the at least one annular member 86 and 88 radially within the canister 52, 54, 56 and 58, locating the at least one annular member 86 and 88 radially within the at least one annular sub portion 59A and 59B of the annular chamber 59 to support the canister 52, 54, 56 and 58 at the predetermined axial position to form a hot isostatic pressing tool 50, d) supplying powder material into the annular chamber 59, e) evacuating gases from the chamber 59 and then sealing the annular chamber 59, f) applying heat and pressure to consolidate the powder material within the annular chamber 59 of the hot isostatic pressing tool 50 to form a consolidated powder material article and g) removing the hot isostatic pressing tool 50 from the consolidated powder material article.

The method comprises the steps of:—a) forming a plurality of canister members 52, 54, 56 and 58, providing interlocking features 60, 62, 64, 66, 68, 70 and 72 on an at least one set of adjacent canister members 52, 54, 56 and 58, the interlocking features forming a U-shaped or a Z-shaped leakage flow path between the at least one set of adjacent canister members 52, 54, 56 and 58, sealing the canister members 52, 54, 56 and 58 together to form the canister of the hot isostatic pressing tool 50, b) forming a support structure 84, the support structure 84 annular members 86 and 88, c) arranging annular members 86 and 88 radially within the canister 52, 54, 56 and 58, locating the annular members 86 and 88 radially within the annular sub portions 59A and 59B of the annular chamber 59 to support the canister 52, 54, 56 and 58 at the predetermined axial position to form a hot isostatic pressing tool 50, d) supplying powder alloy 61 into the chamber 59, 59A and 59B defined between the plurality of canister members 52, 54, 56 and 58 of the hot isostatic pressing tool 50, e) evacuating gases from the chamber 59, 59A and 59B and then sealing the chamber 59, 59A and 59B, f) g) applying heat and pressure to consolidate the powder alloy within the chamber 59, 59A and 59B of the hot isostatic pressing tool 50 to form a consolidated powder alloy combustor casing 32 and h) removing the hot isostatic pressing tool 50 from the consolidated powder alloy combustor casing 32.

Step a) comprises forming an inner cylindrical canister member 52, forming an outer cylindrical canister member 54, forming a first end ring 56, forming a second end ring 56 and arranging the outer cylindrical canister member 54 such that it is spaced radially outwardly from the inner cylindrical canister member 52 to form the chamber 59. Step a) comprises providing the first end ring 56 and the first end 52A of the inner cylindrical canister member 52 with interlocking features 60 and 62 forming a U-shaped or a Z-shaped leakage flow path between the first end ring 56 and the first end 52A of the inner cylindrical canister member 52, providing the second end ring 58 and the second end 52B of the inner cylindrical canister member 52 with interlocking features 64 and 66 forming a U-shaped or a Z-shaped leakage flow path between the second end ring 58 and the second end 52A of the inner cylindrical canister member 52, providing the first end ring 56 and the first end 54A of the outer cylindrical canister member 54 with interlocking features 68 and 70 forming a U-shaped or a Z-shaped leakage flow path between the first end ring 56 and the first end 54A of the outer cylindrical canister member 54 and providing the second end ring 58 and the second end 54B of the outer cylindrical canister member 54 with interlocking features 72 and 74 forming a U-shaped or a Z-shaped leakage flow path between the second end ring 58 and the second end 54B of the outer cylindrical canister member 54. Step a) comprises sealing 92 the first end ring 56 to the first end 52A of the inner cylindrical canister member 52, sealing 94 the second end ring 58 to the second end 52A of the inner cylindrical canister member 52, sealing 96 the first end ring 56 to the first end 54A of the outer cylindrical canister member 54 and sealing 98 the second end ring 58 to the second end 54B of the outer cylindrical canister member 54 to form the hot isostatic pressing tool 50. Step d) comprises supplying powder alloy 61 into the chamber 59, 59A and 59B between the inner cylindrical canister member 52 and the outer cylindrical canister member 54 of the hot isostatic pressing tool 50.

The sealing 92, 94, 96 and 98 of the canister members 52, 54, 56 and 58 comprises welding, e.g. TIG welding or other suitable welding technique. The seal 92 between the first end ring 56 and the first end 52A of the inner cylindrical canister member 52 is at the radially inner end of the radially inwardly extending membrane 76 at the first end 52A of the inner cylindrical canister member 52. The seal 94 between the second end ring 58 and the second end 52B of the inner cylindrical canister member 52 is at the radially inner end of the radially inwardly extending membrane 78 at the second end 52B of the inner cylindrical canister member 52.

The seal 96 between the first end ring 56 and the first end 54A of the outer cylindrical canister member 54 is at the radially outer and axially upstream end of the radially outwardly and axially extending membrane 80 at the first end 54A of the outer cylindrical canister member 54. The seal 98 between the second end ring 58 and the second end 54B of the outer cylindrical canister member 54 is at the radially outer and axially downstream end of the radially outwardly and axially extending membrane 82 at the second end 54B of the outer cylindrical canister member 54. Each of the seals, welds, 92, 94, 96 and 98 is an annular weld.

The canister members 52, 54, 56 and 58 are formed by machining forged mild steel rings which are then assembled to form the hot isostatic pressing tool 50. Prior to the hot isostatic pressing cycle the canister member 52, 54, 56 and 58 are cleaned, assembled and welded together to form a gas tight seal. The assembled canister members 52, 54, 56 and 58 form a plurality of U-shaped, or a Z-shaped, leakage flow paths which provide a longer and more tortuous route for a gas to enter the hot isostatic pressing tool 50. The interlocking features 60, 62, 64, 66, 68, 70, 72 and 74 provide extra support between the canister members 52, 54, 56 and 58 of the hot isostatic pressing tool 50. In addition the membranes 76, 78, 80 and 82 of the hot isostatic pressing tool 50 are arranged such that the high pressure within the hot isostatic pressing vessel acts on the membranes 76, 78, 80 and 82 of hot isostatic pressing tool 50 to press them against the adjacent first end ring 56 and adjacent second ring 54 to provide an ability to self seal. The interlocking features 60, 62, 64, 66, 68, 70, 72 and 74 and the adjacent flat faces reduce the tensioning effect on the fillet welds 92, 94, 96 and 98. The fillet welds 90, 92, 94 and 96 can be used in the configuration of the present invention because of the association and support of the interlocking features 60, 62, 64, 66, 68, 70, 72 and 74.

Alternative forms of interlocking features may be used such as mortise and tenon, dovetail, dowels, studs, however it is considered that fully annular interlocking features are preferred because these provide maximum support and interlock capability.

The hot isostatic pressing cycle uses temperature of up to 1200° C. and a pressure of up to 150 MPa.

An advantage of the present invention is that it enables the manufacture of relatively large cylindrical, conical or frusto-conical components, e.g. casings, to Nett shape by hot isostatically pressing powder material, e.g. powder metal and allows the use of reduced powder material and reduces the amount of final machining after the powder material has been consolidated by hot isostatic pressing. A further advantage of the present invention is that it enables support of the hot isostatic pressing tool in specific positions using the support member, or support members, whilst reducing the hot isostatic pressing time, because the support structure has minimum mass and requires less energy to raise its temperature to the hot isostatic pressing temperature. Another advantage of the present invention is that the support may be tuned to provide different degrees of support for the hot isostatic pressing tool at different positions by selecting the volume and shape of each support member.

Figure 2:
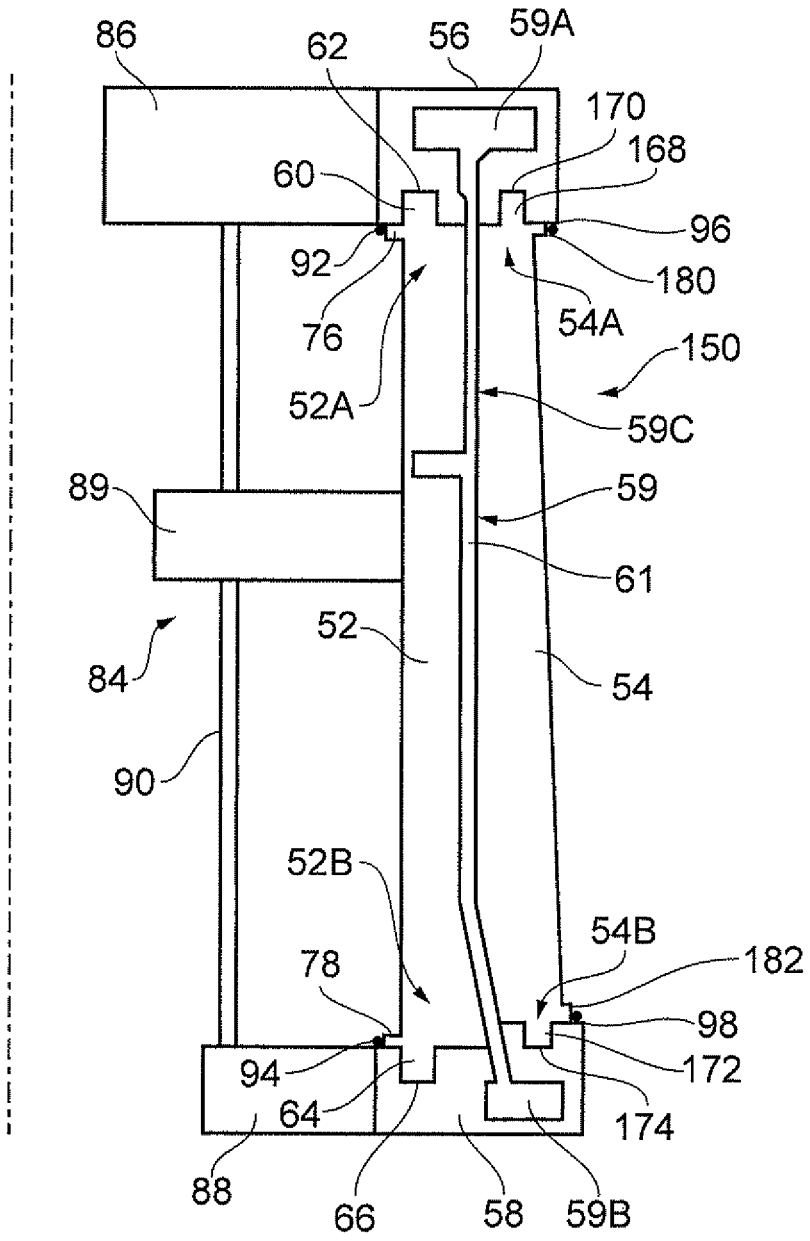
FIG. 2 is a longitudinal cross-sectional view through half of a further hot isostatic pressing tool according to the present invention.

The combustor casing 32 may be manufactured using a hot isostatic pressing tool 150 as shown in FIG. 2. The hot isostatic pressing tool 150 is substantially the same as that shown in FIG. 1 and like parts are denoted by like numerals. The hot isostatic pressing tool 150 differs from that in FIG. 1 in that the interlocking features of the first end ring 56 and the first end 54A of the outer cylindrical canister member 54 comprise an annular groove 170 in the first end ring 56 and an axially extending projection 168 on the first end 54A of the outer cylindrical canister member 54. The interlocking features form a series of Z-shaped leakage flow paths between the first end ring 56 and the first end 54A of the outer cylindrical canister member 54. The first end 54A of the outer cylindrical canister member 54 has a radially outwardly extending membrane 180 abutting the first end ring 56. The interlocking features of the second end ring 58 and the second end 54B of the outer cylindrical canister member 54 comprise an annular groove 174 in the second end ring 58 and an axially extending projection 172 on the second end 54B of the outer cylindrical canister member 54. The interlocking features form a series of Z-shaped leakage flow paths between the second end ring 58 and the second end 548 of the outer cylindrical canister member 54. The second end 54B of the outer cylindrical canister member 54 has a radially outwardly extending membrane 182 abutting the second end ring 56. FIG. 2 also differs in that the support structure 84 comprises a first annular support member 86, a second annular support member 88, a third annular support member 89 and an axially extending support member 90 or a plurality of axially extending support members 90. The third annular support member 89 is positioned at a predetermined axial position between the first and second annular support members 86 and 88 at which support for the inner cylindrical canister member 52 is required. The third annular support member 89 is located radially within the annular chamber 59 to support the inner cylindrical canister member 52 at a third predetermined axial position. The radially outer surface of the third annular support member 89 is radially within the radially inner surface of the inner cylindrical canister member 52. The fit between the third second annular support member 89 and the inner cylindrical canister member 52 is such that at room temperature the support structure 89 is easily placed coaxially within the inner cylindrical canister member 52 but at the hot isostatic pressing temperature the relative thermal expansion of the third annular support member 89 and the inner cylindrical canister member 52 is such that the radially outer surface of the third annular support member 89 abuts the radially inner surface of the inner cylindrical canister member 52 to control the radial position of the inner cylindrical canister member 52 at this axial position and hence control the final position and shape of the finished combustor casing 32. It is seen that the first, second and third annular support members 86, 88 and 89 have different radially inner dimensions, have different volumes and have different masses and hence provide different amounts of support to the radially inner surface of the canister, e.g. the first and second end rings 56 and 58 and the inner cylindrical canister member 52.

Figure 3:
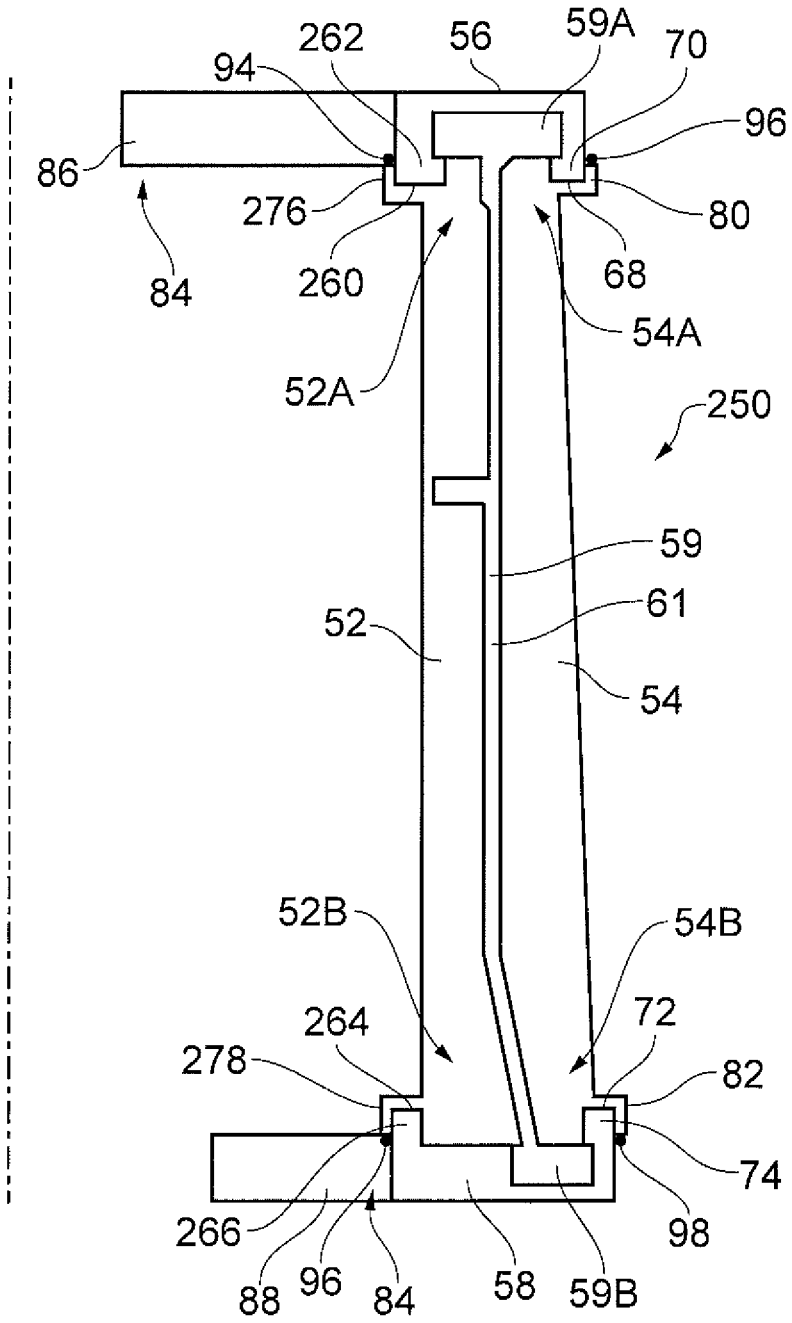
FIG. 3 is a longitudinal cross-sectional view through half of another hot isostatic pressing tool according to the present invention.

The combustor casing 32 may be manufactured using a hot isostatic pressing tool 250 as shown in FIG. 3. The hot isostatic pressing tool 250 is substantially the same as that shown in FIG. 1 and like parts are denoted by like numerals. The hot isostatic pressing tool 250 differs from that in FIG. 1 in that the interlocking features of the first end ring 56 and the first end 52A of the inner cylindrical canister member 52 comprise an annular groove 260 on the inner cylindrical canister member 52 and an annular axially extending projection 262 on the first end ring 56. The interlocking features 260 and 262 form a U-shaped leakage flow paths between the first end ring 56 and the first end 52A of the inner cylindrical canister member 52. The first end 52A of the inner cylindrical canister member 52 has a radially inwardly and axially extending membrane 276 abutting the annular projection 262 on the first second end ring 56. The interlocking features of the second end ring 58 and the second end 52B of the inner cylindrical canister member 52 comprise an annular groove 264 on the inner cylindrical canister member 52 and an annular axially extending projection 266 on the second end ring 58. The interlocking features 264 and 266 form a U-shaped leakage flow paths between the first end ring 56 and the second end 52B of the inner cylindrical canister member 52. The second end 52B of the inner cylindrical canister member 52 has a radially inwardly and axially extending membrane 278 abutting the annular projection 266 on the second end ring 58.

Figure 4:
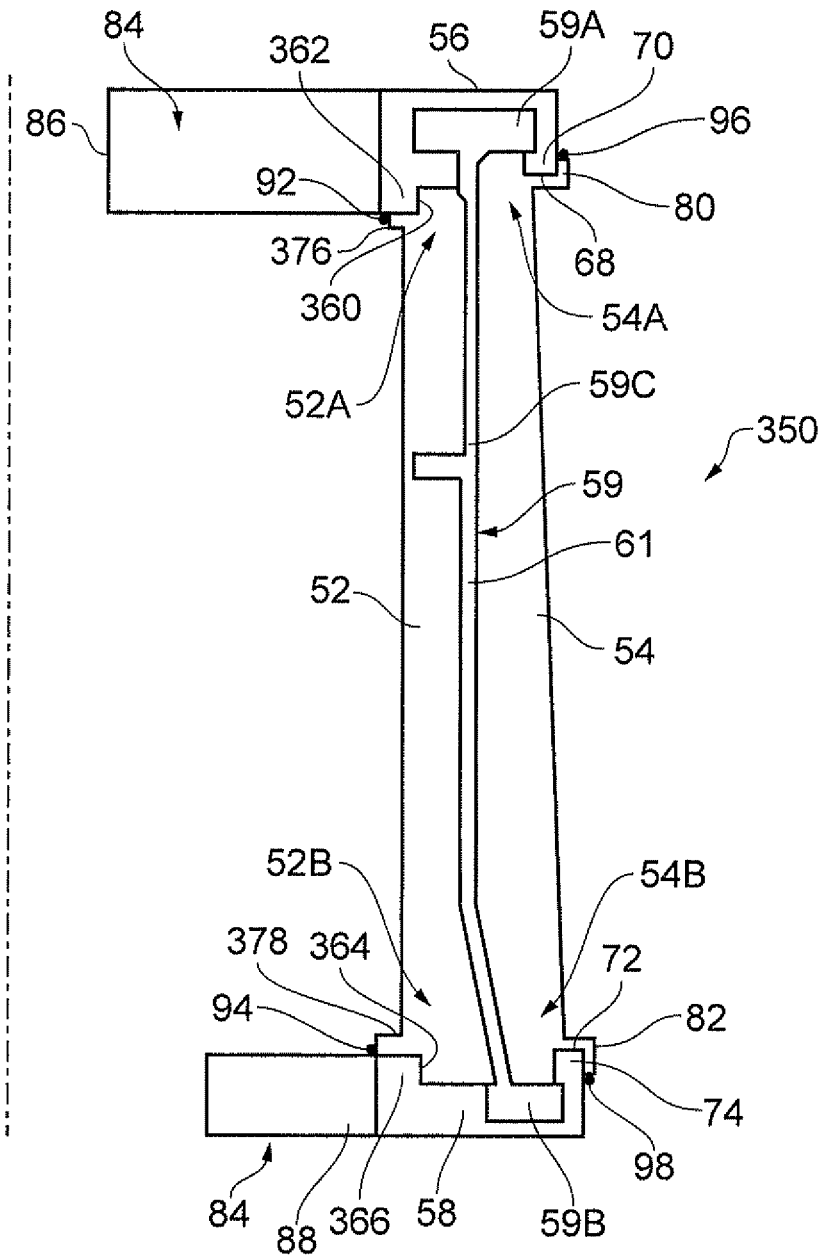
FIG. 4 is a longitudinal cross-sectional view through half of an alternative hot isostatic pressing tool according to the present invention.

The combustor casing 32 may be manufactured using a hot isostatic pressing tool 350 as shown in FIG. 4. The hot isostatic pressing tool 350 is substantially the same as that shown in FIG. 1 and like parts are denoted by like numerals. The hot isostatic pressing tool 350 differs from that in FIG. 1 in that the interlocking features of the first end ring 56 and the first end 52A of the inner cylindrical canister member 52 comprise an annular ledge 360 on the radially inner surface of the inner cylindrical canister member 52 and an annular axially extending projection 362 on the first end ring 56. The annular axially extending projection 362 rests on the annular ledge 360. The interlocking features 360 and 362 form a Z-shaped leakage flow paths between the first end ring 56 and the first end 52A of the inner cylindrical canister member 52. The first end 52A of the inner cylindrical canister member 52 has a radially inwardly and axially extending membrane 376 abutting the annular projection 72 on the first end ring 56. The interlocking features of the second end ring 58 and the second end 52B of the inner cylindrical canister member 52 comprise an annular ledge 364 on the radially inner surface of the inner cylindrical canister member 52 and an annular axially extending projection 366 on the second end ring 58. The annular axially extending projection 366 rests on the annular ledge 364. The interlocking features 364 and 366 form a Z-shaped leakage flow paths between the second end ring 58 and the second end 52B of the inner cylindrical canister member 52. The second end 52B of the inner cylindrical canister member 52 has a radially inwardly and axially extending membrane 378 abutting the annular projection 366 on the second end ring 58.

Figure 5:
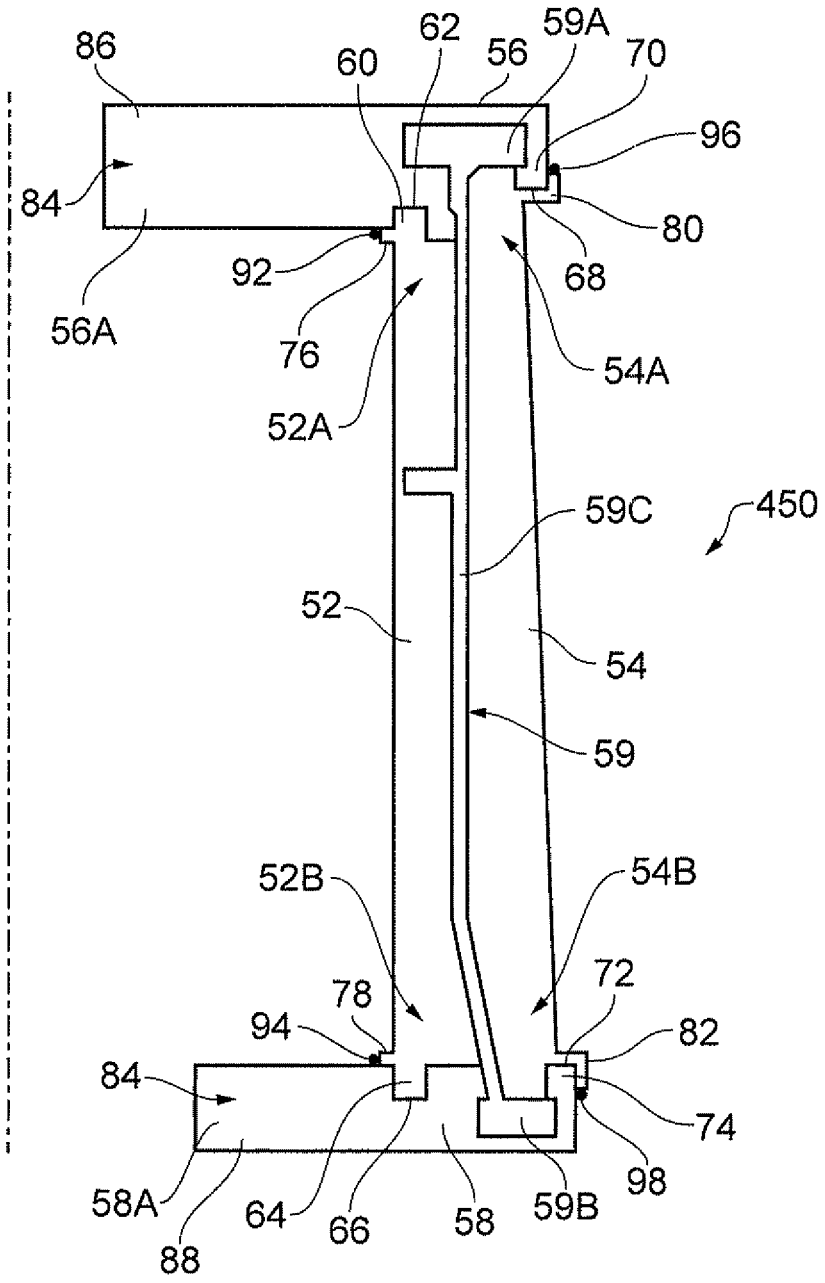
FIG. 5 is a longitudinal cross-sectional view through half of an additional hot isostatic pressing tool according to the present invention.

The combustor casing 32 may be manufactured using a hot isostatic pressing tool 450 as shown in FIG. 5. The hot isostatic pressing tool 450 is substantially the same as that shown in FIG. 1 and like parts are denoted by like numerals. The interlocking features of the first end ring 56 and the first end 52A of the inner cylindrical canister member 52 comprise an annular axially extending projection 60 on the inner cylindrical canister member 52 and an annular groove 62 in the first end ring 56. The interlocking features 60 and 62 form a series of Z-shaped leakage flow paths between the first end ring 56 and the first end 52A of the inner cylindrical canister member 52. The first end 52A of the inner cylindrical canister member 52 has a radially inwardly extending membrane 76 abutting the first end ring 56. The interlocking features of the first end ring 56 and the first end 54A of the outer cylindrical canister member 54 comprise an annular axially extending projection 70 on the first end ring 56 and an annular groove 68 in the first end 54A of the outer cylindrical canister member 54. The interlocking features form a U-shaped leakage flow path between the first end ring 56 and the first end 54A of the outer cylindrical canister member 54. The first end 54A of the outer cylindrical canister member 54 has a radially outwardly and axially extending membrane 80 abutting the annular projection 70 on the first end ring 56. The membrane 80 partially defines the annular groove 68. The interlocking features of the second end ring 58 and the second end 52B of the inner cylindrical canister member 52 comprise an annular axially extending projection 64 on the inner cylindrical canister member 52 and an annular groove 66 in the second end ring 58. The interlocking features 64 and 66 form a series of Z-shaped leakage flow paths between the second end ring 58 and the second end 52B of the inner cylindrical canister member 52. The second end 52B of the inner cylindrical canister member 52 has a radially inwardly extending membrane 78 abutting the second end ring 58. The interlocking features of the second end ring 58 and the second end 54B of the outer cylindrical canister member 54 comprise an annular axially extending projection 74 on the second end ring 58 and an annular groove 72 in the second end 54B of the outer cylindrical canister member 54. The interlocking features form a U-shaped leakage flow path between the second end ring 58 and the second end 54B of the outer cylindrical canister member 54. The second end 54B of the outer cylindrical canister member 54 has a radially outwardly and axially extending membrane 82 abutting the annular projection 72 on the second end ring 58.

The support structure 84 again comprises a first annular support member 86 and a second annular support member 88. The hot isostatic pressing tool 450 differs from that in FIG. 1 in that the first annular support member 86 is integral with the first end ring 56 and the second annular support member 88 is integral with the second end ring 58. In particular the first end ring 56 has an annular portion 56A which extends in a radially inward direction to a radially inner diameter much less than the radially inner diameter of the inner cylindrical canister member 54 and the second end ring 58 has an annular portion 58A which extends in a radially inward direction to a radially inner diameter much less than the radially inner diameter of the inner cylindrical canister member 54. The annular portion 56A of the first end ring 56 and the annular portion 58A of the second ring 58 provide a large mass to the end rings 56 and 58 to resist radially outward or radially inward movement of the end rings as the powder metal 61 in the chamber 59A and 59B is compacted and hence control the radially inner diameter of the hot isostatic pressing tool 450. The annular portion 56A of the first end ring 56 forms the first annular support member 86 and the annular portion 58A of the second end ring 58 forms the second annular support member 88.

Figure 6:
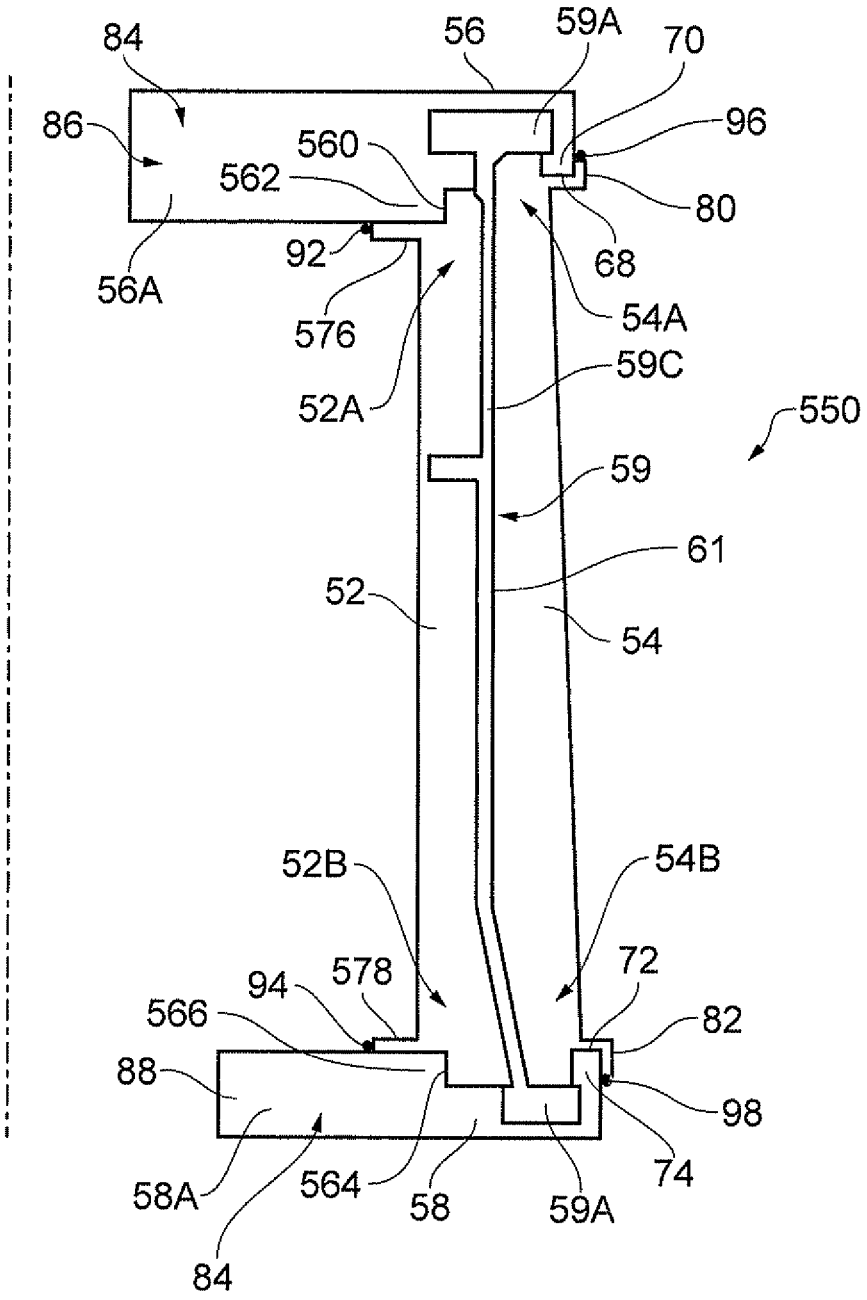
FIG. 6 is a longitudinal cross-sectional view through half of a further hot isostatic pressing tool according to the present invention.

The combustor casing 32 may be manufactured using a hot isostatic pressing tool 550 as shown in FIG. 6. The hot isostatic pressing tool 550 is substantially the same as that shown in FIG. 5 and like parts are denoted by like numerals. The hot isostatic pressing tool 550 is similar to that in FIG. 5 in that the first end ring 56 has an annular portion 56A which extends in a radially inward direction to a radially inner diameter much less than the radially inner diameter of the inner cylindrical canister member 54 and the second end ring 58 has an annular portion 58A which extends in a radially inward direction to a radially inner diameter much less than the radially inner diameter of the inner cylindrical canister member 54. The annular portion 56A of the first end ring 56 and the annular portion 58A of the second ring 58 provide a large mass to the end rings 56 and 58 to resist radially outward or radially inward movement of the end rings as the powder metal 61 in the chamber 59A and 59B is compacted and hence control the radially inner diameter of the hot isostatic pressing tool 450. The hot isostatic pressing tool 550 differs to that in FIG. 5 in that the interlocking features of the first end ring 56 and the first end 52A of the inner cylindrical canister member 52 comprise an annular ledge 560 on the radially inner surface of the inner cylindrical canister member 52 and an annular axially extending projection 562 on the first end ring 56. The annular axially extending projection 562 rests on the annular ledge 560. The interlocking features 560 and 562 form a Z-shaped leakage flow paths between the first end ring 56 and the first end 52A of the inner cylindrical canister member 52. The first end 52A of the inner cylindrical canister member 52 has a radially inwardly and axially extending membrane 576 abutting the annular projection 562 on the first second end ring 56. The interlocking features of the second end ring 58 and the second end 52B of the inner cylindrical canister member 52 comprise an annular ledge 564 on the radially inner surface of the inner cylindrical canister member 52 and an annular axially extending projection 566 on the second end ring 58. The annular axially extending projection 566 rests on the annular ledge 564. The interlocking features 564 and 566 form a Z-shaped leakage flow paths between the second end ring 58 and the first end 52A of the inner cylindrical canister member 52. The second end ring 52B of the inner cylindrical canister member 52 has a radially inwardly and axially extending membrane 578 abutting the annular projection 566 on the second end ring 58.

Figure 9:
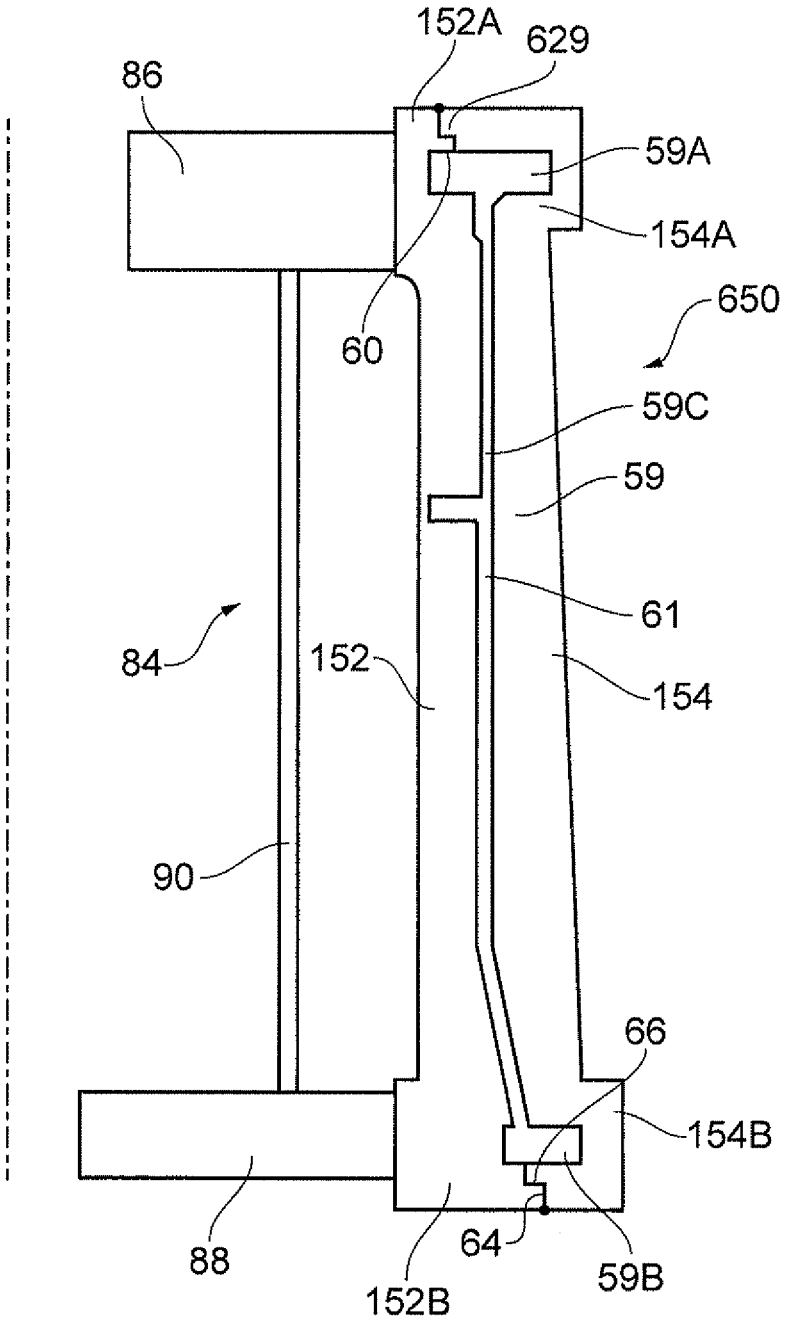
FIG. 9 is a longitudinal cross-sectional view through half of an additional hot isostatic pressing tool according to the present invention.

The combustor casing 32 may be manufactured using a hot isostatic pressing tool 650 as shown in FIG. 9. The hot isostatic pressing tool 650 is substantially the same as that shown in FIG. 1 and like parts are denoted by like numerals. The hot isostatic pressing tool 650 comprises a plurality of canister members 152 and 154 and the hot isostatic pressing tool 650 comprises at least one set of adjacent canister members. In this case a first end 152A of canister member 152 is adjacent a first end 154A of canister member 154 and a second end 152B of canister member 152 is adjacent a second end of the canister member 154. The plurality of canister members 152 and 154 form, or define, a chamber 59 to receive a powder material 61 to be hot isostatically pressed. The at least one set of adjacent canister members 152 and 154 having interlocking features forming a Z-shaped leakage flow path between the at least one set of adjacent second canister members. In this case the first end 152A of canister member 152 and the first end 154A of the adjacent canister member 154 have interlocking features 60 and 62 respectively and the second end 152B of canister member 152 and the second end 154B of the adjacent canister member 154 have interlocking features 64 and 66 respectively. The hot isostatic pressing tool 650 actually comprises an inner cylindrical canister member 152 and an outer cylindrical canister member 154 and the outer cylindrical canister member 154 is spaced radially outwardly from the inner cylindrical canister member 152 to form the chamber 59 to receive the powder material 61 to be hot isostatically pressed.

Similarly, the hot isostatic pressing tool 50 also comprises a support structure 84. The support structure 84 comprises a first annular support member 86, a second annular support member 88 and an axially extending support member 90 or a plurality of axially extending support members 90. The first annular support member 86 is located radially within the first annular sub portion 59A of the annular chamber 59 to support the first end 152A of the inner cylindrical canister member 152 at the first predetermined axial position. The radially outer surface of the first annular support member 186 is radially within the radially inner surface of the first end 154A of the inner cylindrical canister member 152. The second annular support member 88 is located radially within the second annular sub portion 59B of the annular chamber 59 to support the second end 152B of the inner cylindrical canister member 152 at the second predetermined axial position. The radially outer surface of the second annular support member 88 is radially within the radially inner surface of the second end 152B of the inner cylindrical canister member 152. The fit between the first and second annular support members 86 and 88 and the corresponding first and second end ends 152A and 152B of the inner cylindrical canister member 152 is such that at room temperature the support structure 84 is easily placed coaxially within the first and second ends 152A and 152B of the inner cylindrical canister member 152 but at the hot isostatic pressing temperature the relative thermal expansion of the first annular support member 86 and the first end 152A and the relative expansion of the second annular support member 88 and the second end 152B is such that the radially outer surface of the first annular support member 86 abuts the radially inner surface of the first end 152A and the radially outer surface of the second annular support member 88 abuts the radially inner surface of the second end 152B to control the radial positions of the first and second ends 152A and 152B and hence control the final positions and shape of the flanges 38 and 40 in the finished combustor casing 32. The first and second annular support members 86 and 88 extend in a radially inward direction to a radially inner diameter much less than the radially inner diameter of the inner cylindrical canister member 52.

The powder material may comprise a powder metal or a powder alloy. The powder alloy may comprise a nickel base superalloy, a titanium alloy, a steel alloy. The method may comprise supplying different powder alloys, or different powder metals, into different regions of the chamber.

The consolidated powder material article may be a casing. The casing may be a gas turbine engine casing. The casing may be a turbine casing, a compressor casing, a fan casing or a combustion casing.

The canister members of the hot isostatic pressing tool of the present invention may be formed by machining forged mild steel rings which are then assembled to form the hot isostatic pressing tool. Alternatively the canister members of the hot isostatic pressing tool of the present invention may be formed by casting or may be produced by hot isostatic pressing of powder metal. The canister members may comprise mild steel, preferably mild steel comprising 2 wt % carbon. All the internal surfaces of the canister members which contact powder material, metal or alloy, are machined accurately to enable the production of a precise Nett shape article and the interlocking features forming the U-shaped or Z-shaped leakage flow path are machined accurately to ensure integrity during the hot isostatic pressing process. The internal surfaces of the canister members which contact powder material, metal or alloy, may be provided with a barrier layer to inhibit the diffusion of carbides and ferrites from the mild steel canister members into the powder material, metal or alloy e.g. nickel base superalloy, during the hot isostatic pressing procedure. The barrier layer may comprise a nickel alloy, boron nitride or yttria.

In all of the embodiments of the present invention the canister comprises a radially inner wall portion and a radially outer wall portion. It is to be noted that in all the embodiments of the present invention the annular member, or annular members, of the support structure are located radially within the radially inner wall portion of the canister within a bore defined by the radially inner wall portion of the canister. It is also noted that in all the embodiments of the present invention the, or each, annular member is positioned at an axial position such that a portion of the annular chamber surrounds the annular member with the radially inner wall portion of the canister positioned radially between the annular support member and the annular chamber. In the case of the separate annular support members of FIGS. 1 to 4 and 9 the radially outer surfaces of the annular support members are arranged to abut the radially inner surface of the radially inner wall portion of the canister during hot isostatic pressing to support the canister. In the case of the separate annular support members of FIGS. 1 to 4 and 9 the radially outer surfaces of the annular members are the same or less than the radially inner diameter of the radially inner wall portion of the canister. The separate annular support members also extend radially inwardly to a radially inner diameter much less than the radially inner diameter of the radially inner wall portion of the canister. In the case of the integral annular support members of FIGS. 5 and 6 the annular support members are integral with the canister and extend radially inwardly to a radially inner diameter much less than the radially inner diameter of the radially inner wall portion of the canister. In all the embodiments of the present invention the annular support members support the radially inner surface of the canister, e.g. the radially inner surface of the radially inner wall portion of the canister during hot isostatic pressing.

Although the present invention has been specifically described with respect to a canister comprising four canister members it is equally applicable to a canister comprising two or more canister members.

Although the present invention has been described with reference to a hot isostatic pressing tool for producing a gas turbine engine casing it may be suitable for a hot isostatic pressing tool for producing casings for other engines, or for producing other cylindrical, conical or frustoconical articles or apparatus, for example pipes, tubes, valves, heat exchangers.

Although the present invention has been described with reference to the provision of a single annular support member at each of the predetermined axial positions to support the canister, it may be possible to provide two or more annular support members at each of the predetermined axial positions and the annular support members may be axially spaced or may abut each other. Although the present invention has been described with reference to supporting the canister radially within an annular sub portion of the annular chamber having a radial dimension greater than the predetermined radial dimension of the annular chamber, the present invention is equally applicable to supporting the canister radially within any predetermined axial position which is likely to be deformed radially inwardly during the hot isostatic pressing process.

Although the present invention has been described with reference to an annular chamber having cylindrical, conical or frustoconical inner and outer surfaces, e.g. which are circular in cross-section, the present invention may also be applicable to other annular chambers which have polygonal inner and outer surfaces, e.g. square, pentagonal, hexagonal, octagonal etc in cross-section.

The invention claimed is:

1. A hot isostatic pressing tool comprising a canister and a support structure, the canister forming an annular chamber to receive a powder material to be hot isostatically pressed, the support structure comprising at least one annular member arranged radially within the canister, the at least one annular member being located radially within the canister to support the canister at a predetermined axial position, the canister having a radially inner diameter and the at least one annular member being located radially within the radially inner diameter of the canister.

2. A hot isostatic pressing tool as claimed in claim 1 wherein the annular chamber having an annular portion having a predetermined radial dimension and at least one annular sub portion at the predetermined axial position having a radial dimension greater than the predetermined radial dimension, the at least one annular member being located radially within the at least one annular sub portion of the annular chamber to support the canister at the predetermined axial position.

3. A hot isostatic pressing tool as claimed in claim 1 comprising an inner cylindrical canister member, an outer cylindrical canister member, a first end ring and a second end ring, the inner cylindrical canister member, the outer cylindrical canister member, the first end ring and the second end ring forming the annular chamber, the outer cylindrical canister member being spaced radially outwardly from the inner cylindrical canister member to form the annular portion of the chamber, the first end ring being secured and sealed to the inner cylindrical canister member and to the outer cylindrical canister member, the second end ring being secured and sealed to the inner cylindrical canister member and to the outer cylindrical canister member.

4. A hot isostatic pressing tool as claimed in claim 3 wherein the first end ring forming a first annular sub portion of the chamber and the annular member being located radially within the first annular sub portion of the annular chamber to support the first end ring at the predetermined axial position.

5. A hot isostatic pressing tool as claimed in claim 4 wherein the annular member is integral with the first end ring, the annular member is a radially inwardly extending annular portion of the first end ring, the radially inner diameter of the annular portion is less than the radially inner diameter of the inner cylindrical canister member.

6. A hot isostatic pressing tool as claimed in claim 4 wherein the second end ring forming a second annular sub portion of the annular chamber and a second annular member being located radially within the second annular sub portion of the annular chamber to support the second end ring at a second predetermined axial position.

7. A hot isostatic pressing tool as claimed in claim 6 wherein the second annular member is integral with the second end ring, the second annular member is a radially inwardly extending annular portion of the second end ring, the radially inner diameter of the annular portion is less than the radially inner diameter of the inner cylindrical canister member.

8. A hot isostatic pressing tool as claimed in claim 6 wherein the first annular member is separate from the first end ring and the second annular member is separate from the second end ring.

9. A hot isostatic pressing tool as claimed in claim 8 wherein at least one axially extending support member extends between and is secured to the first annular member and the second annular member.

10. A hot isostatic pressing tool as claimed in claim 9 wherein the at least one axially extending support member is selected from the group consisting of graphite and a ceramic.

11. A hot isostatic pressing tool as claimed in claim 8 wherein the first annular support member and the second annular support member comprises a high nickel iron alloy, the high nickel iron alloy consists of 25 wt % nickel, 20 wt % chromium and the balance iron and incidental impurities.

12. A hot isostatic pressing tool as claimed in claim 1 wherein the canister is selected from the group consisting mild steel and mild steel comprising 2 wt % carbon.

13. A method of manufacturing an article from powder material by hot isostatic pressing, the method comprising the steps of:— a) foil ling a canister, the canister defining an annular chamber to receive a powder material to be hot isostatically pressed, b) forming a support structure, the support structure comprising at least one annular member, c) arranging the at least one annular member radially within the canister, locating the at least one annular member radially within the canister to support the canister at a predetermined axial position to form a hot isostatic pressing tool, d) supplying powder material into the annular chamber, e) evacuating gases from the chamber and then sealing the annular chamber, f) applying heat and pressure to consolidate the powder material within the annular chamber of the hot isostatic pressing tool to form a consolidated powder material article and g) removing the hot isostatic pressing tool from the consolidated powder material article.

14. A method as claimed in claim 13 wherein in step a) the annular chamber having an annular portion having a predetermined radial dimension and at least one annular sub portion at a predetermined axial position having a radial dimension greater than the predetermined radial dimension, and step c) comprises locating the at least one annular member radially within the at least one annular sub portion of the annular chamber to support the canister at the predetermined axial position to form the hot isostatic pressing tool.

15. A method as claimed in claim 13 wherein step a) comprises forming an inner cylindrical canister member, forming an outer cylindrical canister member, forming a first end ring, forming a second end ring and arranging the outer cylindrical canister member such that it is spaced radially outwardly from the inner cylindrical canister member to form the annular chamber.

16. A method as claimed in claim 15 wherein step a) comprises forming a first annular sub portion of the chamber in the first end ring and locating the annular member radially within the first annular sub portion of the annular chamber to support the first end ring at the predetermined axial position.

17. A method as claimed in claim 13 wherein the consolidated powder material article is selected from the group consisting of a gas turbine engine casing, a turbine casing, a compressor casing, a fan casing and a combustion casing.

18. A method as claimed in claim 13 wherein the powder material is selected from the group consisting of a powder metal and a powder alloy.

19. A method as claimed in claim 18 wherein the powder alloy is selected from the group consisting of a nickel base superalloy, a titanium alloy and a steel alloy.

20. A method as claimed in claim 18 comprising supplying different powder materials into different regions of the chamber.

21. A hot isostatic pressing tool comprising a canister and a support structure, the canister forming an annular chamber to receive a powder material to be hot isostatically pressed, the canister comprising a radially inner wall portion and a radially outer wall portion, the radially inner wall portion having a radially inner diameter, the support structure comprising at least one annular member arranged radially within the canister, the at least one annular support member having a radially outer diameter, the at least one annular member being located radially within the radially inner wall portion of the canister to support the canister at a predetermined axial position, the at least one annular member being separate from the canister, the radially outer surface of the at least one annular member having a diameter selected from the group consisting of a diameter the same as the radially inner diameter of the radially inner wall portion of the canister and a diameter less than the radially inner diameter of the radially inner wall portion of the canister.

22. A hot isostatic pressing tool as claimed in claim 1 comprising an inner conical canister member, an outer conical canister member, a first end ring, a second end ring, the inner conical canister member, the outer conical canister member, the first end ring and the second end ring forming the annular chamber, the outer conical canister member being spaced radially from the inner conical canister member to form the annular portion of the chamber, the first end ring being secured and sealed to the inner conical canister member and the outer conical canister member and the second end ring being secured and sealed to the inner conical canister member and the outer conical canister member.

* * * * *